US009278044B2

(12) United States Patent
Roubal

(10) Patent No.: US 9,278,044 B2
(45) Date of Patent: Mar. 8, 2016

(54) CELLULITE APPEARANCE REDUCTION APPARATUS AND METHOD

(75) Inventor: Paul J. Roubal, Troy, MI (US)

(73) Assignee: Paul's Engineering, Inc., Palm City, FL (US)

( * ) Notice: Subject to any disclaimer, the term of this patent is extended or adjusted under 35 U.S.C. 154(b) by 792 days.

(21) Appl. No.: 13/476,404

(22) Filed: May 21, 2012

(65) Prior Publication Data

US 2012/0302928 A1 Nov. 29, 2012

Related U.S. Application Data

(60) Provisional application No. 61/489,980, filed on May 25, 2011.

(51) Int. Cl.

| | |
|---|---|
| ***A61H 1/02*** | (2006.01) |
| ***A61H 11/02*** | (2006.01) |
| ***A61H 23/02*** | (2006.01) |

(52) U.S. Cl.

CPC ..... *A61H 11/02* (2013.01); *A61H 23/0254* (2013.01); *A61H 2201/169* (2013.01); *A61H 2207/00* (2013.01)

(58) Field of Classification Search

CPC . A61H 11/00; A61H 11/02; A61H 2011/005; A61H 2201/169; A61H 2201/1692; A61H 2201/1695; A61H 1/00; A61H 1/02; A61H 2205/086; A61H 23/0254; A61H 2207/00

USPC ..... 601/5, 70, 71, 124, 143, 144, 145, 146, 601/147; 155/66

See application file for complete search history.

(56) References Cited

U.S. PATENT DOCUMENTS

| | | | | |
|---|---|---|---|---|
| 1,807,308 | A * | 5/1931 | De Remer | 601/143 |
| 1,812,891 | A | 7/1931 | Meehan | |
| 1,919,062 | A * | 7/1933 | Haynes | 601/143 |
| 2,154,831 | A * | 4/1939 | Booharin | 601/143 |
| 5,097,822 | A * | 3/1992 | Francis et al. | 601/101 |
| 2002/0188236 | A1 | 12/2002 | Lin | |
| 2006/0019805 | A1 * | 1/2006 | Heck | 482/121 |

FOREIGN PATENT DOCUMENTS

| | | |
|---|---|---|
| DE | 1491605 | 1/1970 |

OTHER PUBLICATIONS

Korean Itellectual Property Office, International Search Report and Written Opinion in corresponding international application No. PCT/US2012/040058, dated Oct. 4, 2012.

(Continued)

*Primary Examiner* — Quang D Thanh

(74) *Attorney, Agent, or Firm* — Young Basile Hanlon & Macfarlane P.C.

(57) ABSTRACT

The invention includes devices and methods for reducing the appearance of cellulite in human skin. The device includes a belt having a tactile gripping portion for removably adhering to skin. When the belt is connected to a reciprocating vibratory massage device, the tactile belt grips the skin preventing substantial relative movement between the belt and the skin. On continued reciprocal movement of the belt through a stroke length and at a frequency, the outer layers of the skin are forcibly moved relative to the subcutaneous tissue layers thereby disrupting, stretching and/or tearing fat/collagen projections extending from the subcutaneous tissue into the outer skin layers thereby reducing the appearance of cellulite in the skin.

10 Claims, 6 Drawing Sheets

(56) References Cited

OTHER PUBLICATIONS www.dycem.com, Website, www.dycem-ns.com/panels.php, May 17, 2012, Panels & Strips.

www.ib3health.com, 6 Speed Beauty Massager, website, www.ib3health.com/products/BodySlimMassager/BeautyMassagerSixSpeed.asp Apr. 14, 2012, pp. 1-4.

www.sunpentown.com, SPT UC-633: Heath & Beauty Belt Massager, one page, Apr. 14, 2012.

Supplementary European Search Report in corresponding EP 12 78 9579, dated Mar. 2, 2015.

* cited by examiner

CELLULITE APPEARANCE REDUCTION APPARATUS AND METHOD

CROSS-REFERENCE TO RELATED APPLICATIONS

This application claims priority benefit to U.S. Provisional Patent Application No. 61/489,890 filed May 25, 2011 the entire contents of which are incorporated herein by reference.

FIELD OF INVENTION

The present invention generally pertains to devices and methods for reducing the appearance of cellulite in humans.

BACKGROUND OF THE INVENTION

Humans, and especially aging individuals, are increasingly sensitive with physical appearances. Almost all female individuals, to various degrees, develop bumpy, fatty tissue deposits in the subcutaneous tissue layers deep under the skin which extend or project into the skin. These uneven and irregular fat cell/collagen projections from the subcutaneous tissue layers into the skin manifest in an undesirable dimpled or bumpy appearance to the skin which is generally called cellulite. Various devices and procedures have been proposed to reduce or eliminate this cellulite appearance or skin condition. The proposed devices and treatments include laser, topical creams, injections of homeopathic extracts, vitamins, vacuum rolling, radio waves, massage, subcision surgery, silicone injection, liposuction and skin kneading. These prior devices or procedures suffer from one or more disadvantages of either not being effective, require expensive equipment, or require administration by medical professionals in multiple procedures often costing tens of thousands of dollars.

It would be advantageous to develop a device and method which reduces or eliminates the cellulite appearance or skin condition generated in the subcutaneous tissue layers beneath the outer skin. It would be further advantageous if the devices and methods were able to be used and executed without the need for invasive medical procedures; expensive medical facilities, equipment or treatment or direct observation by medical professionals. It would further be advantageous for the devices and methods to be compatible with conventional exercise equipment, be relatively inexpensive and used by individuals in the comfort of their own homes.

SUMMARY OF INVENTION

The present invention includes devices and methods for reducing the appearance of cellulite in human skin. In one example of the inventive device, an elongate belt is provided having connectors adjacent opposing ends. The connectors are adapted for engagement with a conventional vibratory massage device. The belt includes a grip portion which is positioned to cover at least a center portion of the belt between the opposing ends. The grip portion of the belt includes a contact surface used to directly contact with the skin of a user, for example the thigh of a person. When connected to the reciprocating massage device, the grip portion tactilely grips the skin resisting relative motion between the belt and the skin while creating relative movement between the adhered outer skin layers relative to the subcutaneous tissue layers. The devices and processes have been shown to be effective in reducing the appearance of cellulite in the area of use.

In other examples of the device, the belt includes grip portions on both sides of the belt and end connectors which are adaptable for alternating use of both sides of the belt for increased durability and possibly different grip portions on opposing sides of the belt.

In another example, the belt grip portion wraps around the upper and lower edges of the belt.

In an example of a method for reducing cellulite appearance in skin, a belt having a gripping portion is positioned partially around a user in an area where the appearance of cellulite is present. A tactile contact surface of the gripping portion is placed against the skin removably adhering the belt to the skin. In one example, the belt is connected to a reciprocating or vibratory message machine which is activated. While the belt is moved in a back and forth fashion at a frequency, the tactile belt contact surface grips the adhered skin and rapidly moves the outer layers of the skin relative to the subcutaneous tissue layers thereby disrupting, stretching, tearing or severing the fat cell/collagen projections extending into the outer skin layers reducing the cellulite appearance which is highly desired by women.

In a method of forming a belt for use in reducing the appearance of cellulite, an elongate belt is formed with a gripping portion having a tactile contact surface which is removably connected to the skin as described above. Connectors are attached to the belt for aiding reciprocal movement of the belt in a manner described above, for example a reciprocal vibratory massage device.

Other examples of devices and methods of the present invention are illustrated and described below, as well as similar devices and methods known by those skilled in the art, are within the scope of the present invention.

BRIEF DESCRIPTION OF THE DRAWING

The description herein makes reference to the accompanying drawings wherein like reference numerals refer like parts throughout the several views and wherein.

DETAILED DESCRIPTION OF THE PREFERRED EMBODIMENT

Figure 1:
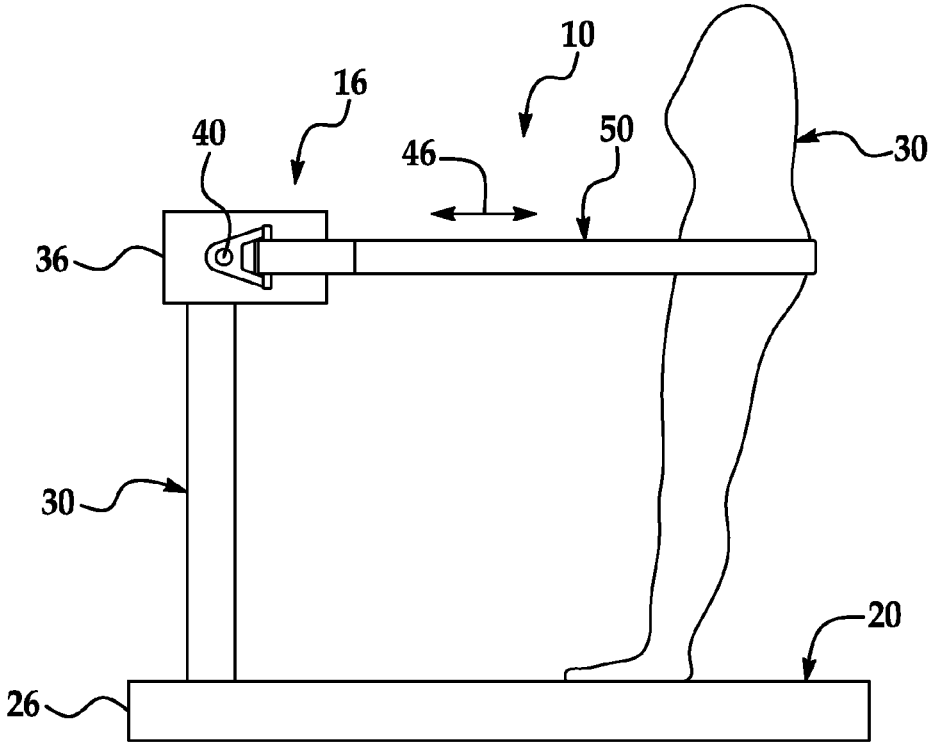
FIG. 1 is a schematic view of an example of the inventive cellulite reduction belt in an exemplary method with an exemplary commercial vibratory massage device.

Examples of an inventive cellulite appearance reduction device 10 and methods 200 are illustrated in FIGS. 1-12. The exemplary device and methods as further explained below are, in one example, intended for use with commercially available reciprocating vibratory massage machines 16 seen generally in FIG. 1. Referring to FIG. 1, an exemplary massage machine 16 useful with the invention 10 generally includes a platform 20 including a forward end 26 and an upstanding post 30 as generally shown. In the example shown, the vibratory machine includes a reciprocation or vibratory generator head 36. The head 36 includes opposing members 40 on opposing sides of the head 36 which generate a reciprocating or back-and-forth, generally linear movement or stroke length 46 at the opposing members 40 which serve as connection points for an inventive belt described below. An example of a suitable massage machine 16 is the Six Speed Beauty Massager sold by ib3 Health. Other similar devices known by those skilled in the art may be used.

Referring to FIGS. 1-10, examples of a cellulite reduction belt 50 are illustrated. An exemplary method for reduction of cellulite includes use of the belt 50 with the exemplary vibratory massage device 16 described above. Referring to FIGS. 2-9 one example of belt 50 for use with an exemplary connector 100 for connection of the belt 50 to the massage device 16 is illustrated.

Figure 2:
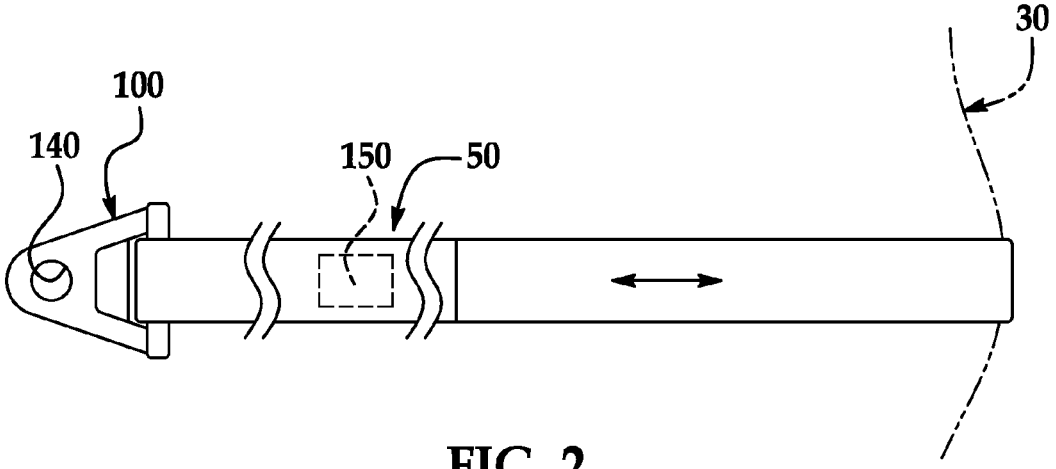
FIG. 2 is a side elevational view of an example of a belt assembly shown in FIG. 1.
Figure 3:
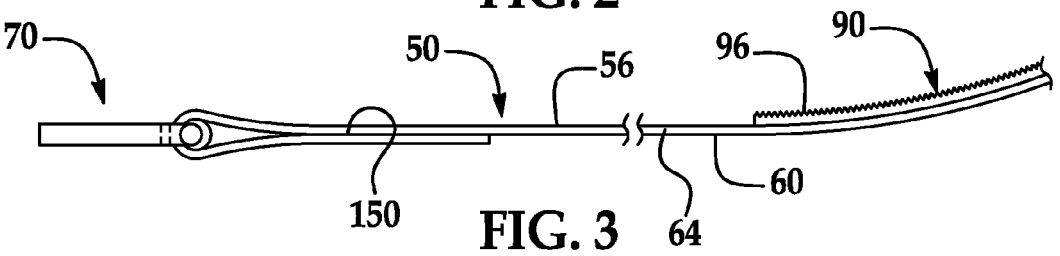
FIG. 3 is a fragmentary top view of one end of the belt assembly of FIG. 2 illustrating an example of an end connector.
Figure 7:
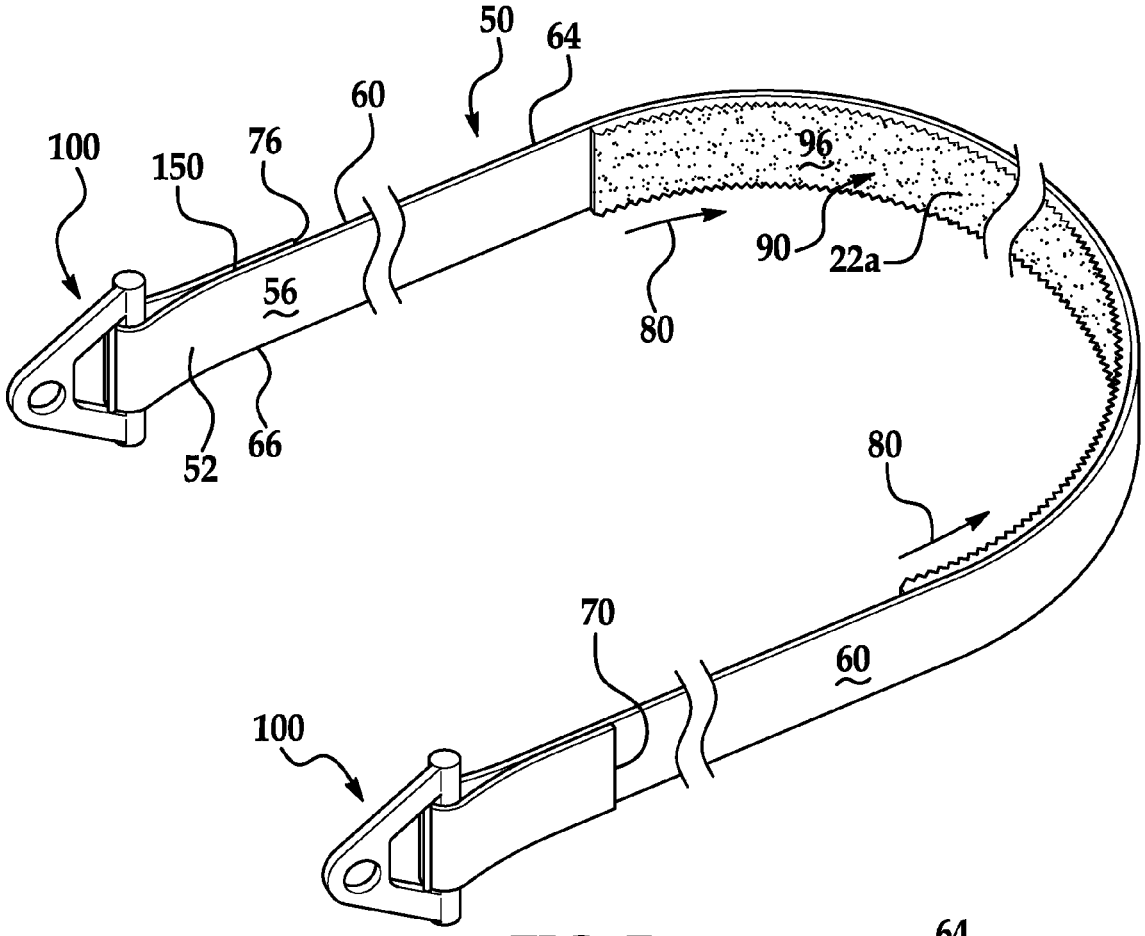
FIG. 7 is a perspective view of the belt assembly shown in FIG. 1 with an exemplary end connector for use in an exemplary method.

Referring to FIGS. 2, 3 and 7, exemplary belt 50 is a wide, thin belt or strap 52 including a first side 56, an opposing second side 60 defining a belt thickness 62 and edges 64 and 66. Belt 50 terminates at opposing ends 70 and 76. In the example shown, belt 50 includes a gripping portion 80 positioned on the strap 52 first side 56 between the ends 70 and 76 as generally shown. Belt strap 52 may be formed of natural materials, for example leather, or of woven, extruded molded or other processed nylon, textiles, polymers, elastomers or other natural or manufactured materials suitable for the particular application. In one example, a suitable belt strap 52 is four (4) inches wide, one-sixteenth (1/16) of an inch thick formed from heavy-duty woven polypropylene or nylon. Other sizes and configurations of belt straps 52 known by those skilled in the art may be used.

Figure 4:
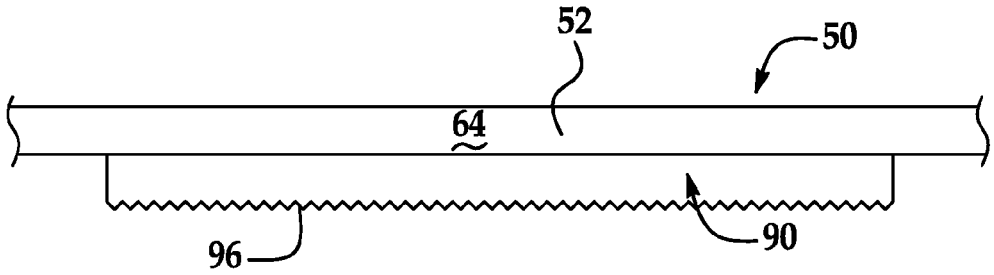
FIG. 4 is a enlarged fragmentary top view of the belt assembly of FIG. 3 illustrating a gripping portion on one side of the belt.

In the illustrated example, gripping portion 80 is defined by a film 90 adhered to the belt inner surface 56. In a preferred example, film 90 is a substantially non-slip, gripping layer or contact surface 96 having a tactile or sticky quality. At least part of the gripping portion 80 and contact surface 96 is intended to directly contact the user's skin in the area where cellulite is desired to be reduced. Gripping portion 80 and contact surface 96 having the above features and characteristics may come in many forms and materials. In one example, film 90 is a thin, extruded or molded material sold under the trade name Dycem manufactured by Dycem Limited which is securely attached belt inner surface 56 as best seen in FIGS. 3, 4 and 7. The exemplary film 90 of Dycem material is secured to belt strap 52 through adhesive applied to one side of the film 90 and inner surface 56. Other methods of securing film 90 to strap 52 known by those skilled in the art may be used.

Figure 8:
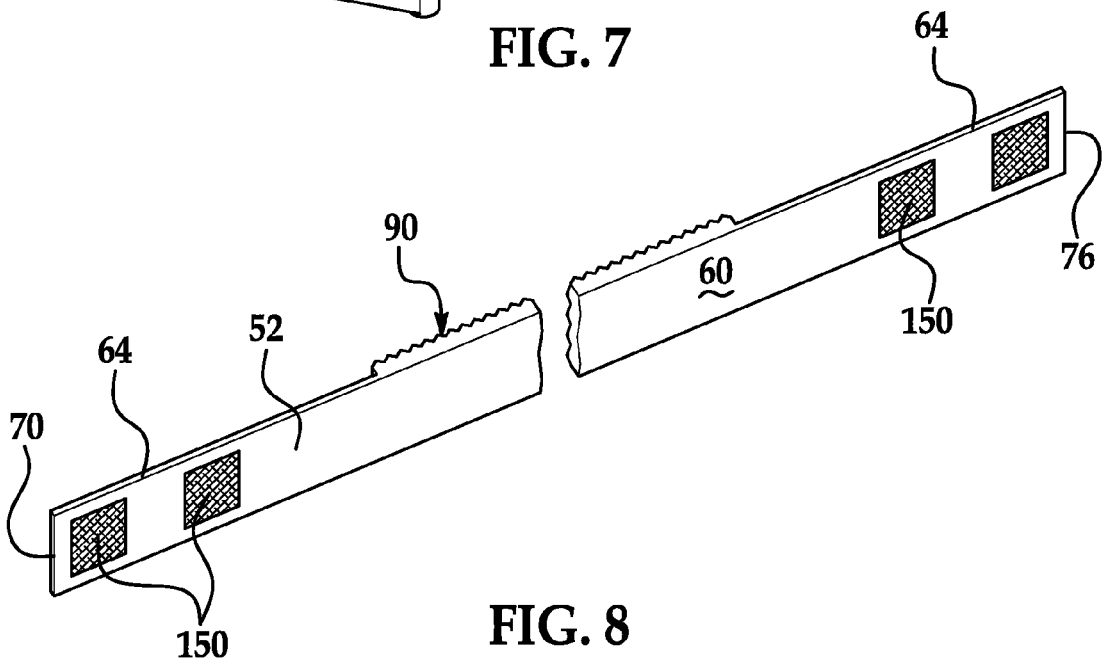
FIG. 8 is an alternate perspective view of the belt shown in FIG. 7 without the universal connector.
Figure 9:
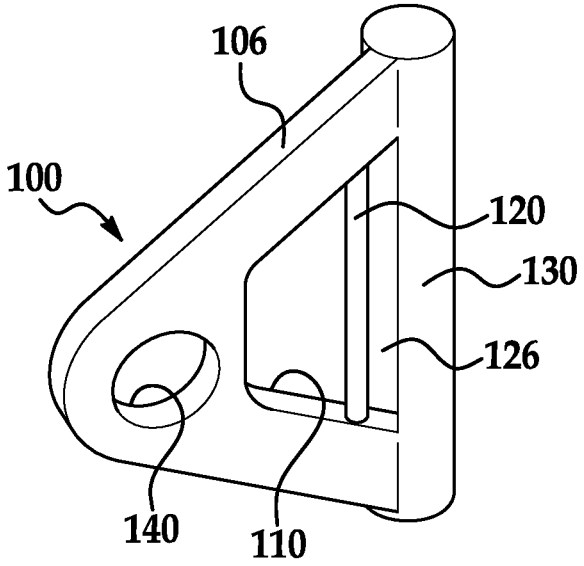
FIG. 9 is a perspective view of the exemplary connector shown in FIG. 7.

The exemplary film 90 Dycem material is a thin, pliable, flexible material that has a slight cushioning property and exhibits a tactile or slightly sticky surface which gently "grips" or sticks to clean human skin when placed in contact and put under mild pressure. Other suitable materials having these qualities and characteristics known by those skilled in the art may be used. Suitable materials would also preferably exhibit qualities of being easily removed from contact with the skin without discomfort to the user, are easily cleaned and sanitized, are suitable and durable under high frequency reciprocal and/or vibratory movement when in contact with skin, may be securely attached or integrated with belt strap 52 in efficient manufacturing processes and are of relatively low cost. In the example illustrated in FIG. 2-7, the film 90 is applied to only one side of the strap 52 inner surface 56 and does not extend beyond, or wrap around edges 64 or 66. FIG. 8 shows an example where the material 90 and contact surface 90 may be integral or impregnated in the belt substrate material including upper edge 64 as shown.

Figure 10:
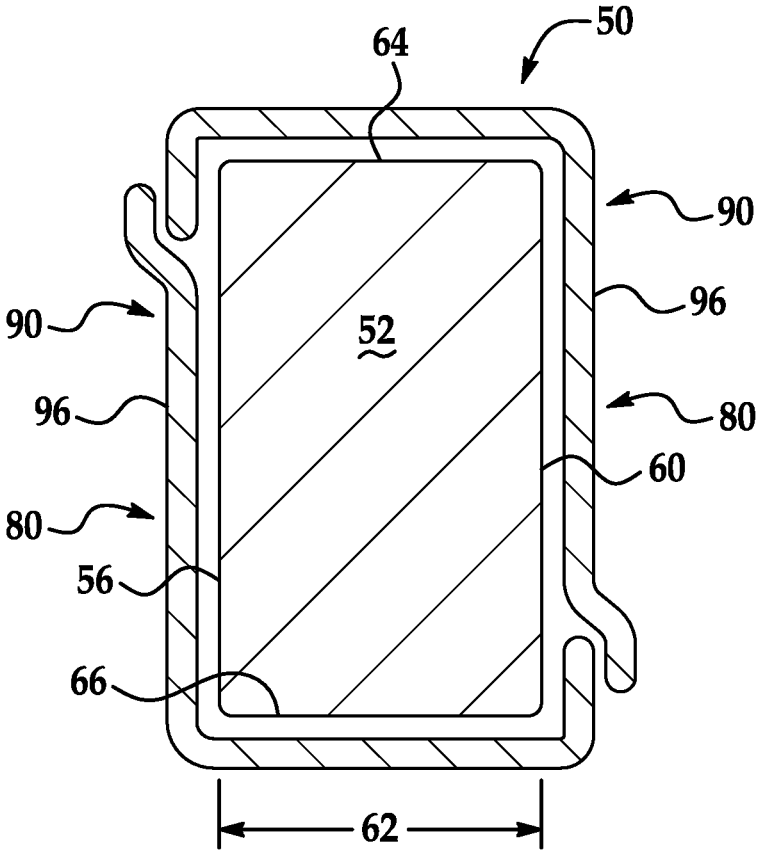
FIG. 10 is an enlarged cross-sectional view of an alternate belt shown in FIG. 4 illustrating an exemplary structure of a gripping portion on both sides and edges of the belt.

In an alternate example of belt 50 shown in FIG. 10, belt 50 includes gripping portions 80 and contact surfaces 96 on both of the inner 56 and outer 60 surfaces of strap 52. Using the exemplary film 90 forming the gripping portion 80 described above, film 90 is secured to both sides of belt 50 and wraps around edges 64 and 66 as generally shown. Film 90 is secured to strap 52 in the manner described above (spaces between films 90 and strap 52 shown for convenience of illustration only). When secured film 90 is rigidly secured to strap 52 allowing no relative movement between films 90 and strap 52. It is understood that other orientations and methods of securing film 90 to strap 52, for example the areas of overlap of the two films 90, known by those skilled in the art may be used. In the enlarged cross-section shown in FIG. 10, despite the areas of double-thickness of film 90, contact surfaces 96 are substantially flat and free from raised edges which may disrupt the "grip" or tactile portion 80 and contact with a user's skin or otherwise cause an area of irritation or undue friction. In a preferred example, gripping or contacting surface 96 may be relatively smooth or may have a texture depending on the application and performance requirements of the condition to be treated or preferences of the user.

In alternate examples of belt 50 not illustrated, it is understood that grip portion 80 may be formed from other materials and/or manufacturing processes. Referring to FIG. 10, it is understood that forming a gripping portion 80 on both sides 56 and 60 can be achieved through a single piece of film 90 wrapped around the circumference of the belt and adhered back on itself reducing the exposed edges or seams. It is contemplated that strap 50 could be dipped, coated or molded with a material fully covering the sides 56 and 60 and edges 64 and 66. If is further contemplated that strap 56 could be formed through impregnating or integrating a suitable material in the belt material itself or into the woven structure to provide a suitable gripping portion 80 having the tactile, skin gripping and other characteristics described above.

In another example, strap 50 may be manufactured from a material that exhibits the qualities and characteristics described above without separate films or coatings. Other materials, methods and processes to achieve the characteristics and qualities of belt 50 and gripping portion 80 described above known by those skilled in the art may be used. Further, although the gripping portion 80 shown in the FIG. 7 example is shown covering only a portion of the strap 52 length between the connectors 100, it is understood that the gripping portion can extend along a greater length, for example the entire belt between the connectors 100, or a lesser length of strap 52 than shown in FIG. 7. It is further contemplated that the gripping portion may not be substantially centered on the strap 52 length as illustrated and may comprise multiple gripping portions separated along belt strap 52 (not illustrated). Other locations and orientations of gripping portion 80 along strap 52 may be used to suit the application and as known by those skilled in the art.

Referring to FIGS. 2, 3 and 7-9 an example of connectors 100 used to quickly attach belt 50 to reciprocating massage device 16 is illustrated. In a preferred example, connector 100 is universal, compatible and easily engaged with the opposing members 40 of many commercial massage devices. Alternately, different connectors 100 could be included or offered with belt 50 to achieve ease of use on many commercial devices.

In the example connector 100 illustrated, connector 100 is generally shown in a D-ring configuration and includes a plate 106 defining an opening 110. Plate 106 further includes a cinch bar 120 defining a belt opening 126 and a post 130 as generally shown. In the example, connector 100 includes a drive opening 140, preferably serving as a universal opening or connection point for engagement of the connectors 100 and belt 50 to opposing members 40 of the massage device 16 as best seen in FIG. 1.

In example illustrated, connectors 100 are securely, but removably connected to strap 52 adjacent the ends 70 and 76. In one example of use with exemplary connector 100, strap 52 includes connection pads 150 secured to the belt and spaced apart along strap 52 as generally shown. In a preferred example, pads 150 are VELCRO-type hook and loop or other secure, but easily connectable and removable devices. Each end 70 and 76 of strap 52 is passed through the belt opening 126 between post 130 and cinch bar 120 of a respective connector 100. As best seen in FIGS. 2 and 8, the respective ends 70 or 76 are double-backed and the respective pads 150 of the respective end of the strap are aligned and engaged with one another to define a loop passing through and mounting the respective connector 100 to strap 52. With connectors 100 securely fastened to strap 52, belt 50 can be connected to massage device 16 as described above.

Although shown generally as a D-shaped plate, it is understood that connectors 100 can take many other forms, structures, geometries and orientations, or and may be secured to strap 52 in many other ways, as known by those skilled in the art. For example, connectors 100 may include a pin or hook (not shown) which connects to coordinating members 40 of the massage device 16 to securely and effectively transfer the reciprocating and/or vibratory motion of the device 16 to the belt 50.

Further, other structures, geometries and methods for securing strap 52 to connector 100 may be used. For example, belt ends 70 and 76 may have a direct mechanical or friction-type connection to a portion of connector 100 instead of the illustrated single loop-through design. In such an instance, other structures and means may be used to adjust the length of the belt to suit the application or user. Other structures and configurations for attaching belt 22 back in itself other than hook and loop-type pads 150 may be used to accommodate very heavy individuals, for example dual D-shaped cinch rings where the belt ends 70 and 76 are looped through and pulled or cinched tight. It is contemplated that where the grip portions 80 are of long duration or are replaceable, the attachment of strap 52 to connectors 100 can be permanent through heavy duty stitching, mechanical fasteners or other devices and methods known by those skilled in the art. Although described as a universal connector 100, two or more different connectors could be packaged with the exemplary belt 50 and the appropriate connectors for a user's massage device 16 may be used. Alternately, where the belt 50 is used with a device other than massage device 16, other connectors 100 or devices suitable for those applications may be used without deviating from the present invention.

Figure 11:
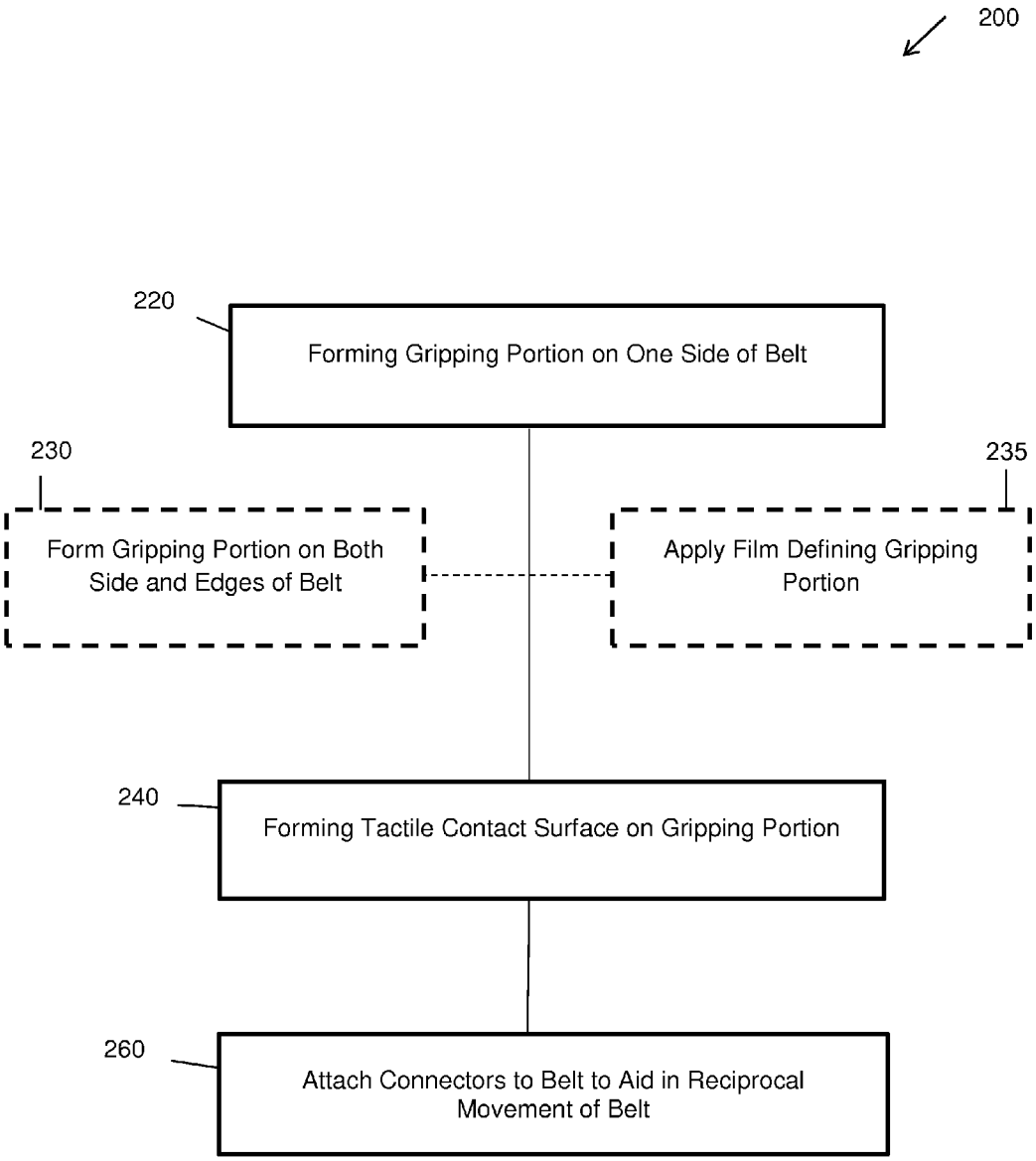
FIG. 11 is schematic flow chart showing an exemplary method for forming a belt for reducing the appearance of cellulite.

Referring to FIG. 11, an exemplary method for forming a belt for use in reducing the appearance of cellulite on human skin 200 is illustrated. In the exemplary method, in step 220 a gripping portion 80 is formed on an elongate belt strap 52 described in detail above.

In step 240, a tactile contact surface 96 is formed on at least a portion of the gripping portion. The gripping portion 80 and contact surface may be formed in many ways or methods described above which produce a durable tactile or slightly sticky surface which mildly sticks or grips the skin preventing all, or substantially all, relative movement between a user's outer skin and the contact surface 96 of the gripping portion.

In an alternate step 230, the gripping portion can be formed on both sides 56 and 60 of the belt strap 52 as well as the edges 64 and 66 as described in detail above.

In an alternate step 235, the gripping portion and contact surface can be defined by a film 90 that is attached to the belt strap as described above.

In exemplary method step 240, connectors 100 are attached to the belt which aid in the belt being reciprocally moved in the manner described above. These connectors may be for use with commercial reciprocal machines or simpler reciprocal means, for example, handles for pulling by the user or an assistant.

Figure 5:
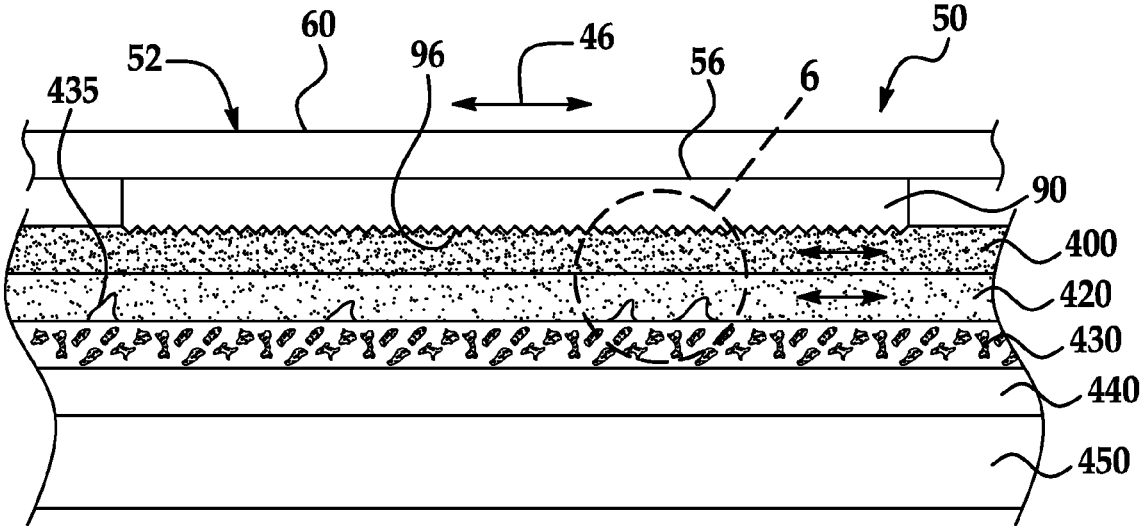
FIG. 5 is an enlarged cross-sectional view of the belt shown in FIG. 4 in an exemplary use in direct contact with the skin of a user.
Figure 6:
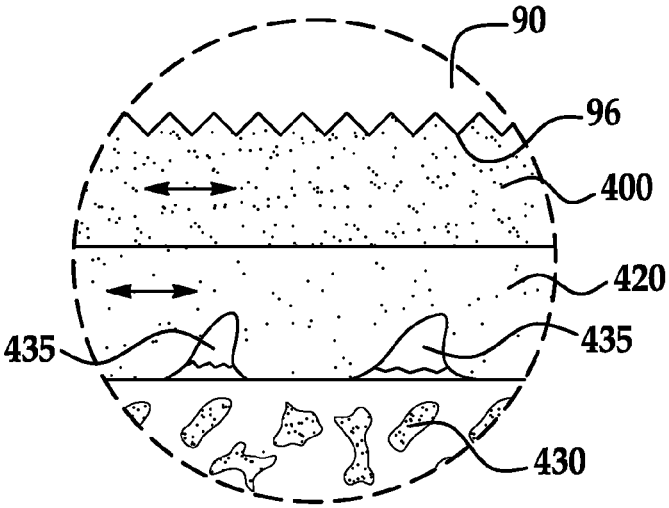
FIG. 6 is an enlarged view taken within the circle 6 of FIG. 5.
Figure 12:
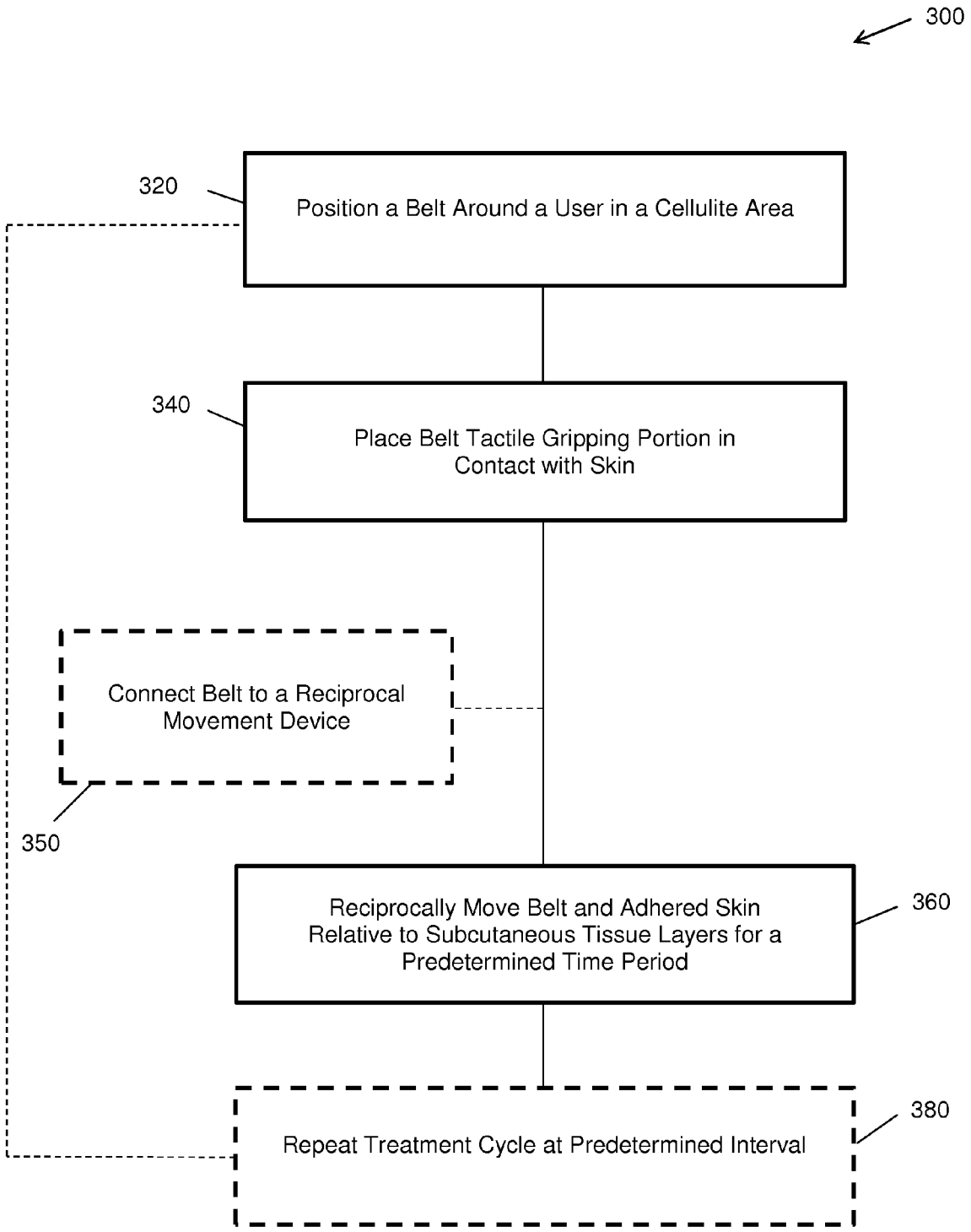
FIG. 12 is a schematic flow chart showing an exemplary method for reducing the appearance of cellulite in human skin.

Referring to FIGS. 12 and 5 and 6, an exemplary method for reducing cellulite appearance in human skin 300 is illustrated. In the example, step 320 includes placing the belt strap 52 partially around a selected area of a user 30 where cellulite is desired to be reduced, for example in the buttocks or thigh as generally shown in FIG. 1.

In step 340, and as best seen in FIGS. 5 and 6, the strap 52 gripping portion 80 contact surface 96 is preferably placed in direct contact with the naked, outer layer epidermis 300 through mild contact pressure. The gripping portion 80 tactile or generally non-slip surface 96 functions to physically "grip" or mildly stick to the epidermis or outer skin layer 26.

In an optional, but preferred step 350, the belt 50 is oriented and connected to a vibratory or reciprocal massage device through connectors 100 as generally described above. In a most simplistic example, hand handles could be used instead of connecting belt 50 to a commercial reciprocation device.

In step 360, in a preferred method having belt 50 connected to a vibratory or reciprocal device 16, device 16 imparts a selectable amount of reciprocal, linear, back-and-forth movement in a direction and along a stroke length 46 to the belt 50 at a high frequency. For example, the linear back-and-forth movement or stroke length 46 that belt 50 moves may range from one (1) centimeter (cm) to four (4) centimeters (cm) for every 360 degree revolution of opposing member 40 of device 16 about an axis of rotation in head 36. In an exemplary device 16, the frequency of opposing members 40 may range from several hundred revolutions per minute (RPMs) to 7600 RPMs or more. Different stroke lengths 46 and frequency of the stroke length or RPMs of device 16 may extend outside this range without deviating from the present invention. In one example, it has been determined that setting of a stroke length 46 of two (2.0) centimeters at a frequency of 530 RPM is suitable for treatment of cellulite in a healthy, middle aged, relatively fit, user 30.

In exemplary method step 360, the preferably high frequency reciprocal movement of the device 16 and belt 50 is imparted to the user's outer skin layers, the epidermis layer remaining in gripping, substantially non-relative moving contact with the gripping portion contact surface 96 of belt strap 52. As the belt 50 is reciprocated and/or vibrated by the massage machine 16, the gripped epidermis skin layer 400 along with the inner dermis skin layer 420 is pulled at a selected high frequency relative to the subcutaneous tissue layers 430 (only one layer shown for ease of illustration) between the fascia 440 and muscle 450 layers for a predetermined time or treatment period. This causes a high frequency pulling and "tearing" relative motion action or effect on the fat cell/collagen projections 435 that extend from the subcutaneous tissue layer 430 into the dermis 420 as generally shown. This relative movement of the gripped epidermis 400 and dermis 420 relative to the subcutaneous layer 430 disrupts, tears and/or severs a plurality of fat cell/collagen projections 435 extending between the layers that are forcibly being moved relative to one another. This disruption, stretching, tearing and/or severing of the fat cell/collagen projections 435 has the effect of reducing the visual appearance of cellulite on the epidermis 400 desirable by many health and appearance conscious persons.

In one example, a continuous treatment period using device 16 and belt 50 of 15-30 minutes has been found suitable. Other treatment duration periods beyond this range may be used as known by those skilled in the art and that are found suitable for particular users, the device 16 employed or other equipment used or conditions of the users.

In method step 380, the treatment described above is repeated on a predetermined or variable interval, for example every other day, twice a week or other interval that is found useful to the user to achieve the reduction of cellulite appearance or tone desired, or as prescribed by a medical professional. It is understood that additional or fewer method steps, and in a different order, may be used to achieve the above described objectives may be used without deviating from the present invention.

The described and illustrated inventive devices and methods of employing belt 50 in a method of gripping, pulling, stretching and/or tearing action of the skin in the manner described is in contrast to the action of conventional massage machine belts wherein the belt slides back and forth over the skin and there is no significant relative movement between the outer skin layers and the subcutaneous tissue layers. The inventive belt 50 and methods imparting the relative movement of the outer skin layers relative to the subcutaneous layers has the effect of tearing, breaking up, disrupting or otherwise dissipating the fatty subcutaneous layer deposits and projections into the upper/outer layers of the skin to effectively reduce and/or eliminate the appearance of cellulite.

While the invention has been described in connection with what is presently considered to be the most practical and preferred examples, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A cellulite reduction belt for use with a reciprocating movement device to reduce cellulite deposits in human skin, the belt comprising:

an elongate strap having opposing strap ends, a first side, a second side opposite the first side, first and second edges connecting the first and the second sides; and a thin film gripping portion positioned on the strap first and second sides and the first and second edges between the opposing ends and having a length, the thin film having a first and a second side and a first and a second longitudinal edge, the gripping portion having a substantially continuous tactile contact surface defined by on of the film first or second sides along the entire gripping portion length, the other of the first and second film sides connected to the respective strap first or second sides, wherein on connection of the film first or second side to the strap, the film first and the second longitudinal edges overlap so that no portion of the strap is exposed to human skin in the gripping portion, a selected contact area of the tactile contact contact surface operable to removably and directly adhere to human skin, wherein the gripping portion contact area adhered to the skin transfers reciprocal movement of the strap directly to the adhered skin to reduce cellulite deposits in the adhered skin.

2. The device of claim 1 further comprising a pair of connectors engageable to the strap adjacent the respective strap ends of the strap.

3. The device of claim 2 further comprising a reciprocating movement device having opposing members respectively engageable with the strap connectors, the movement device operable to reciprocally move the elongate strap along a linear path defined by a longitudinal axis of the elongate strap at a selectable stroke length and at a predetermined frequency to transfer the reciprocating movement from the movement device to the adhered to skin.

4. The device of claim 1 wherein the thin film comprises a first thin film piece and a second thin film piece, each of the first and the second thin film pieces wrap around a portion of the strap.

5. A device for use in reducing cellulite deposits in the subcutaneous layers in human skin, the device comprising:

a reciprocating movement device, the device having opposing members for generating linear reciprocal movement along a stroke length at a predetermined frequency;

a belt removably connected to the movement device, the belt comprising:

an elongate strap having opposing strap ends, a first side, a second side opposite the first side, first and second edges connecting the first and the second sides;

a gripping portion having a length positioned between the strap opposing ends, the gripping portion comprising a film connected to and substantially covering the first and the second sides of the strap and the first and the second edges of the strap in the gripping portion, the gripping portion having a continuous tactile contact surface defining a selectable tactile contact area defined by a portion of the tactile contact surface, the tactile contact area removably and directly adherable to a human user's skin over the entire tactile contact area; and a first and a second connector each engageable with a respective strap end and a respective one of the reciprocating device opposing members, wherein the belt transfers the belt linear reciprocal movement from the reciprocating device opposing members directly to the adhered human skin over the entire tactile contact area to grip and pull the adhered skin at the stroke length and at the predetermined frequency.

6. The device of claim 5 wherein the stroke length is about 2 centimeters (cm).

7. The device of claim 5 wherein the predetermined frequency is about 1000 strokes per minute.

8. The belt of claim 5 wherein the substantially continuous tactile contact surface is continuous and is linear between the first and the second edges.

9. The belt of claim 8 wherein the entire gripping portion contact area is adhered to an epidermis layer of the skin and transfers the reciprocal movement of the strap directly to the adhered epidermis thereby moving the adhered epidermis relative to a subcutaneous layers below the epidermis to reduce cellulite.

10. The belt of claim 9 wherein the adhered epidermis is positioned in one of a buttocks or a thigh region of user.

* * * * *